US005572763A

United States Patent [19]

Eguchi

[11] Patent Number: 5,572,763

[45] Date of Patent: Nov. 12, 1996

[54] TOOTHBRUSH

[75] Inventor: Yasuteru Eguchi, Tokyo, Japan

[73] Assignee: Kao Corporation, Tokyo, Japan

[21] Appl. No.: 492,026

[22] PCT Filed: Nov. 11, 1994

[86] PCT No.: PCT/JP94/01917

§ 371 Date: Jun. 29, 1995

§ 102(e) Date: Jun. 29, 1995

[87] PCT Pub. No.: WO95/14403

PCT Pub. Date: Jun. 1, 1995

[30] Foreign Application Priority Data

Nov. 29, 1993 [JP] Japan ..... 5-063793 U

[51] Int. Cl.[6] ..... A46B 9/04

[52] U.S. Cl. ..... 15/167.1; 15/144.1; 15/172; 403/116

[58] Field of Search ..... 15/144.1, 167.1, 15/172; 403/102, 103, 113, 116

[56] References Cited

U.S. PATENT DOCUMENTS

| | | | |
|---|---|---|---|
| 1,405,712 | 2/1922 | Lewis | 15/172 |
| 1,658,383 | 2/1928 | Lewis | 15/172 |
| 4,908,900 | 3/1990 | McLaughlin et al. | 15/172 |

FOREIGN PATENT DOCUMENTS

| | | | |
|---|---|---|---|
| 55-5052 | 2/1980 | Japan . | |
| 61-199231 | 12/1986 | Japan . | |
| 5-95324 | 12/1993 | Japan . | |
| 1164597 | 9/1969 | United Kingdom | 15/167.1 |

*Primary Examiner*—Mark Spisich

*Attorney, Agent, or Firm*—Birch, Stewart, Kolasch & Birch, LLP

[57] ABSTRACT

A toothbrush in which a basal end portion of a neck portion is connected to a distal end portion of a handle portion through a pivotal pin, a slide member for fixedly connecting the basal end portion and the distal end portion is slidably arranged relative to the distal end portion through the pivotal pin, so that the bending angle of the neck portion relative to the handle portion can be adjusted by sliding the slide member, the basal end portion includes a pair of linkage portions which are brought to outer sides of the distal end portion of the handle portion and connected to the distal end portion through the pivotal pin, the linkage portions are each provided with a slant elongated-slit positionally offset toward the bristle portion from the pivotal pin, the handle portion is provided with a slide guide groove for guiding the slide member, the slide member includes a slide basic body having an elongated-slit for receiving the pivotal pin, the slide basic body being slidably fitted in the guide groove and provided with a pair of fit-in projections formed respectively on opposite sides of the slide basic body at areas positionally offset toward the neck portion, the fit-in projections being slidably fitted respectively in the slant elongated-slits, and the slide member further includes a control plate firmly mounted on the basic body.

4 Claims, 4 Drawing Sheets

TOOTHBRUSH

TECHNICAL FIELD

This invention relates to a toothbrush, and more particularly to a toothbrush of the type in that the tilting or bending angle of a neck portion relative to a handle portion can be easily adjusted by a single hand depending on which tooth or which part of a tooth is to be brushed.

BACKGROUND OF THE TECHNIQUE

Heretofore, there is known a toothbrush in which the bending angle of a neck portion relative to a handle portion can be adjusted so that the most inner teeth, which are difficult to brush, such as molar teeth, are not left unbrushed. For example, Japanese Utility Model Laid-Open Application No. 63-13025 discloses a toothbrush in which a handle portion and a neck portion are pivotally supported by a pin and a screw is tightened relative to the pin at a predetermined angle.

Also, Japanese Utility Model Laid-Open Application No. 61-199231 discloses a toothbrush, in which the bending angle of a neck portion relative to a handle portion can be adjusted by sliding a control stick in the forward and backward direction of the handle portion.

However, in the toothbrush described in the above Japanese Utility Model Laid-Open Application No. 63-13025, both hands are required for adjusting the bending angle of the neck portion relative to the handle portion. Also, after the completion of the adjustment of angle, the toothbrush is used, with the neck portion fixedly maintained at that adjusted angle. Therefore, there is such an inconvenience that during the use of the toothbrush, the bending angle of the neck portion relative to the handle portion can not be easily adjusted depending on which tooth or which part of a tooth is to be brushed.

In the toothbrush disclosed in Japanese Utility Model Laid-Open Application No. 61-199231, it is constructionally very difficult to slide the control stick by a desired amount by a single hand during the use of the toothbrush. Moreover, it is constructionally practically impossible to change the bending angle of the neck portion relative to the handle portion in accordance with the sliding amount of the control stick.

SUMMARY OF THE INVENTION

It is, therefore, an object of the present invention to provide a toothbrush in which the bending angle of a neck portion relative to a handle portion can be easily adjusted by a single hand any time during the use of the toothbrush in accordance with the teeth to be brushed.

The present invention has achieved the above object by providing a toothbrush in which a basal end portion of a neck portion having a bristle portion at a distal end of the neck portion is pivotally connected to a distal end portion of a handle portion through a pivotal pin, and a slide member for fixedly maintaining the connected state between the basal end portion and the distal end portion is slidably arranged relative to the distal end portion through the pivotal pin, so that by sliding the slide member forwardly and backwardly relative to the handle portion, a bending angle of the neck portion relative to the handle portion can be adjusted, the basal end portion of the neck portion including a pair of linkage portions which are brought to outer sides of the distal end portion of the handle portion and connected to the distal end portion through the pivotal pin, the pair of linkage portions being each provided with a slant elongated-slit positionally offset toward the bristle portion from the pivotal pin, the handle portion being provided with a slide guide groove for guiding the slide member, the slide member including a slide basic body having an elongated-slit and slidably fitted in the slide guide groove, and a slide control plate integrally mounted on the slide basic body, the slide basic body being provided with a pair of fit-in projections formed respectively on opposite sides of the slide basic body at areas positionally offset toward the neck portion, the pivotal pin being allowed to pierce through the elongated-slit, the fit-in projections being slidably fitted respectively in the slant elongated-slits.

With the toothbrush of the present invention thus constructed, when the bending angle of the neck portion relative to the handle portion is adjusted, in use, depending on which tooth or which part of a tooth is to be brushed, by sliding the slide control plate of the slide member in a direction of the rear end of the handle portion by a finger such as the thumb of a single hand holding the handle portion, the fit-in projections are guided by the slant elongated-slits in the basal end portion of the neck portion and moved from the end portion of the slant elongated-slits, which is positionally offset toward the bristle, to the end portion of the slant elongated-slits, which is positionally offset toward the handle portion. At the same time, the neck portion is turned or pivoted about the pivotal pin, so that the neck portion is bent relative to the handle portion in accordance with the moved distance of the fit-in projections.

Also, by sliding the slide control plate in a direction of the neck portion, the fit-in projections are guided by the slant elongated-slits and moved from the above-mentioned end portion, which is positionally offset toward the handle portion, to the above-mentioned end portion which is positionally offset toward the bristle portion. At the same time, the neck portion is turned or pivoted about the pivotal pin but in the reverse direction to the pivoted direction, so that the neck portion is unbent relative to the handle portion.

DETAILED DESCRIPTION OF THE INVENTION

A toothbrush of the present invention will be described in detail with reference to the accompanying drawing.

Figure 1:
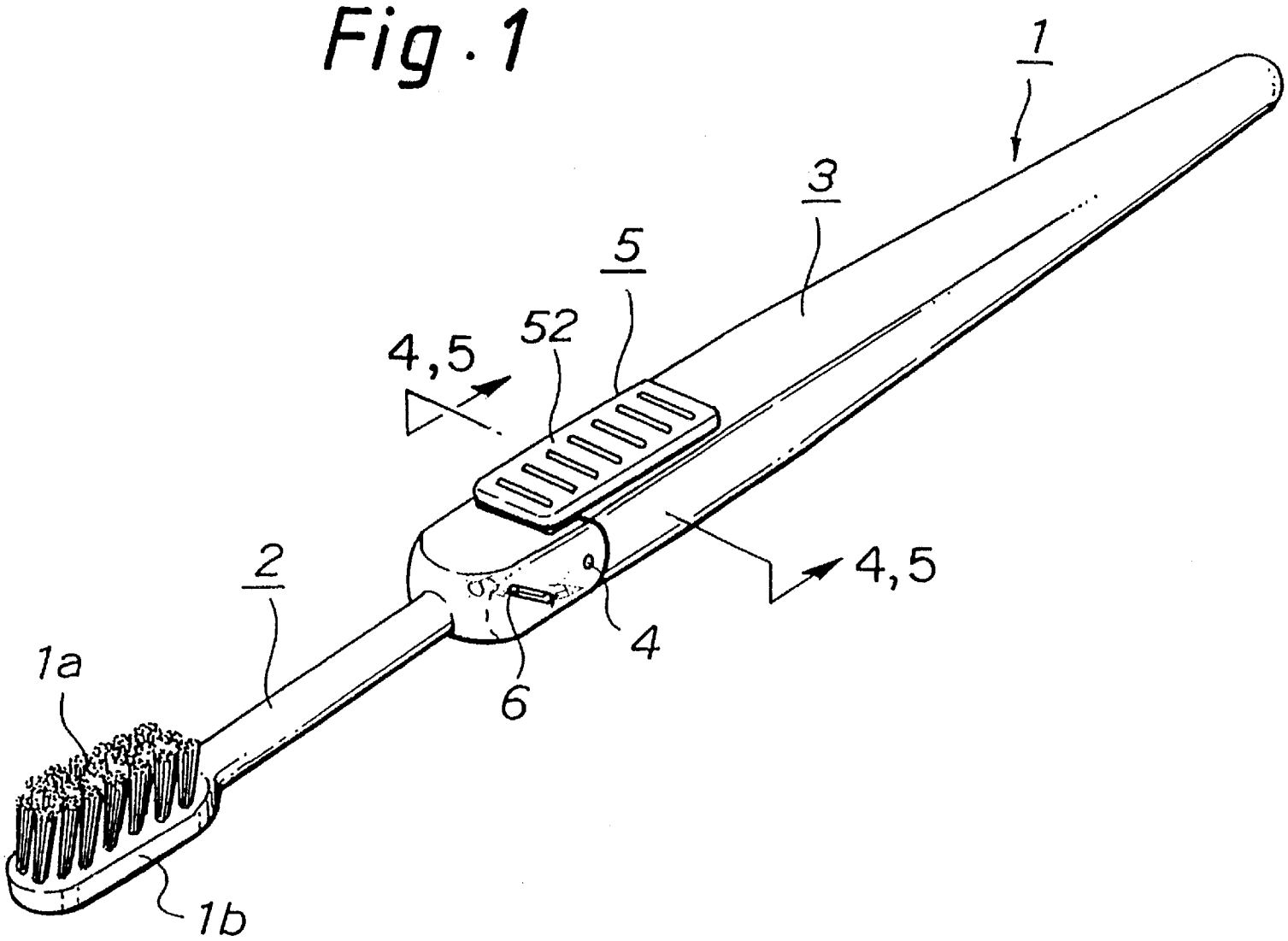
FIG. 1 is a perspective view showing an outer appearance of a toothbrush according to one embodiment of the present invention.
Figure 2:
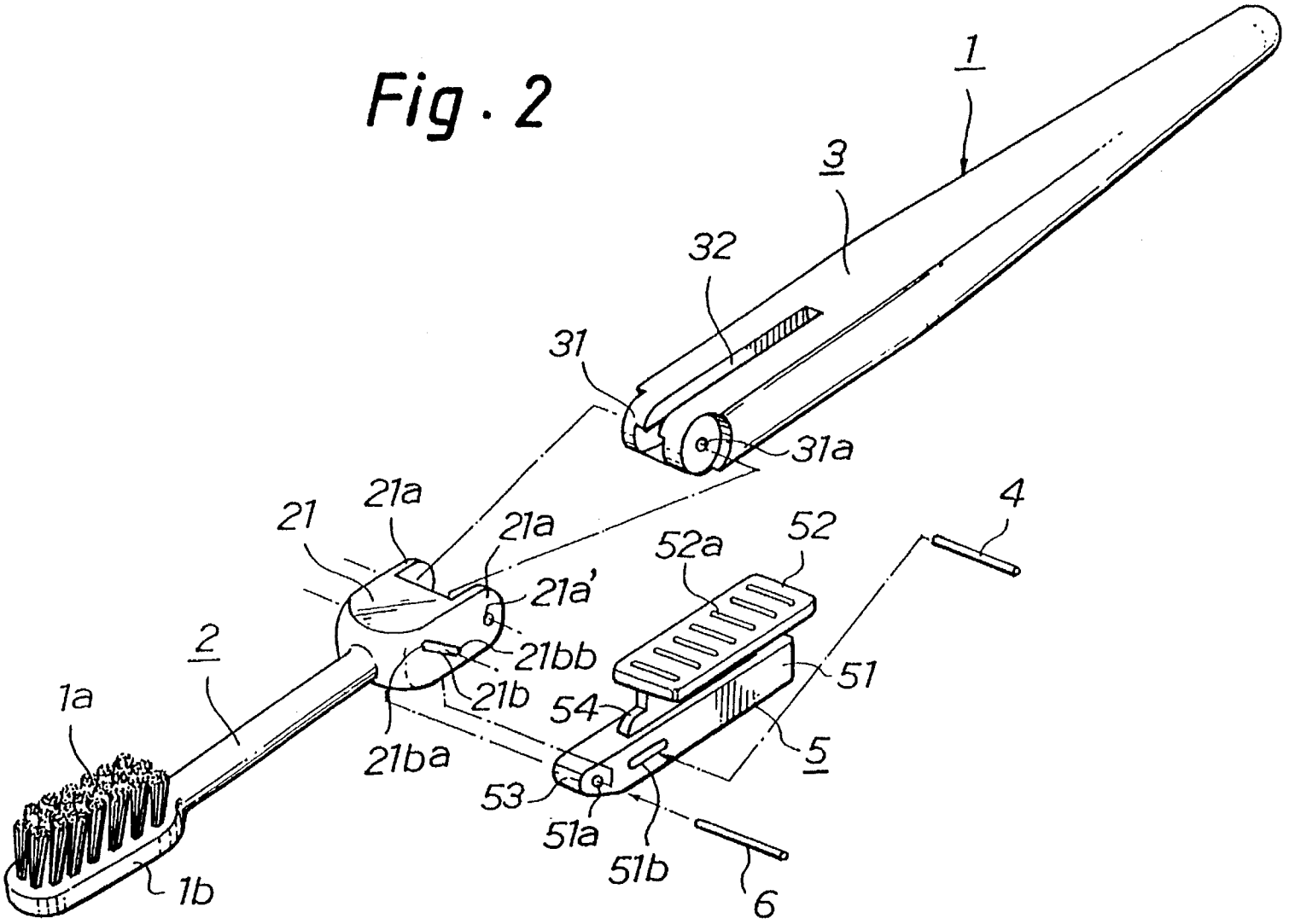
FIG. 2 is an exploded perspective view of the toothbrush of FIG. 1.
Figure 3:
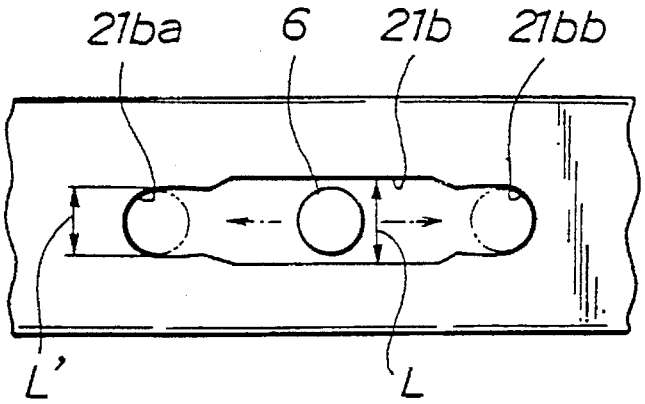
FIG. 3 is an enlarged plan view of a slant elongated-slit of a neck-portion of the toothbrush of FIG. 1.
Figure 4:
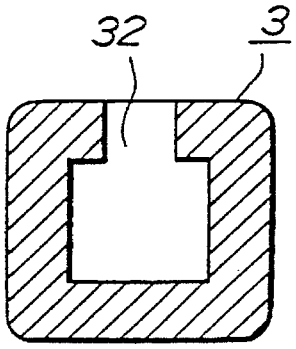
FIG. 4 is an enlarged sectional view taken on line 4—4 of FIG. 1 but in which a slide member is removed therefrom.
Figure 5:
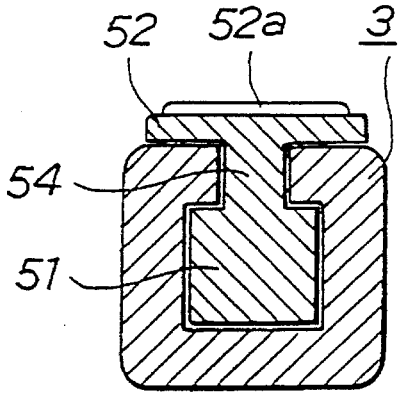
FIG. 5 is an enlarged sectional view taken on line 5—5 of FIG. 1; and FIG. *6a* is a side view showing a state in which the bending angle of a neck portion relative to a handle portion is 0 in the toothbrush of FIG. 1, and FIG. *6b* is a side view showing a state in which the bending angle of the neck portion relative to the handle portion is maximum in the toothbrush of FIG. *6a*.
Figure 6A:
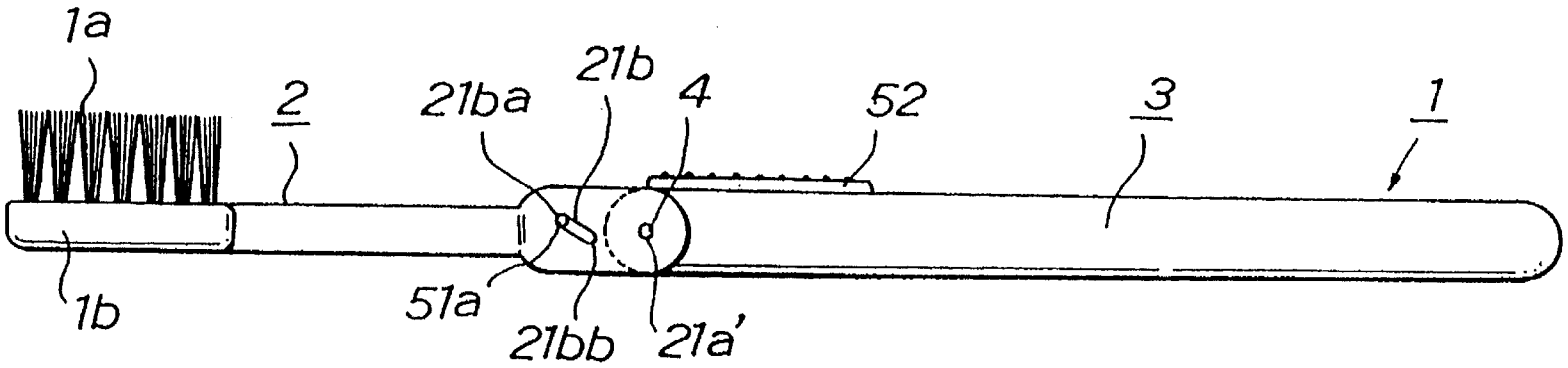
Figure 6B:
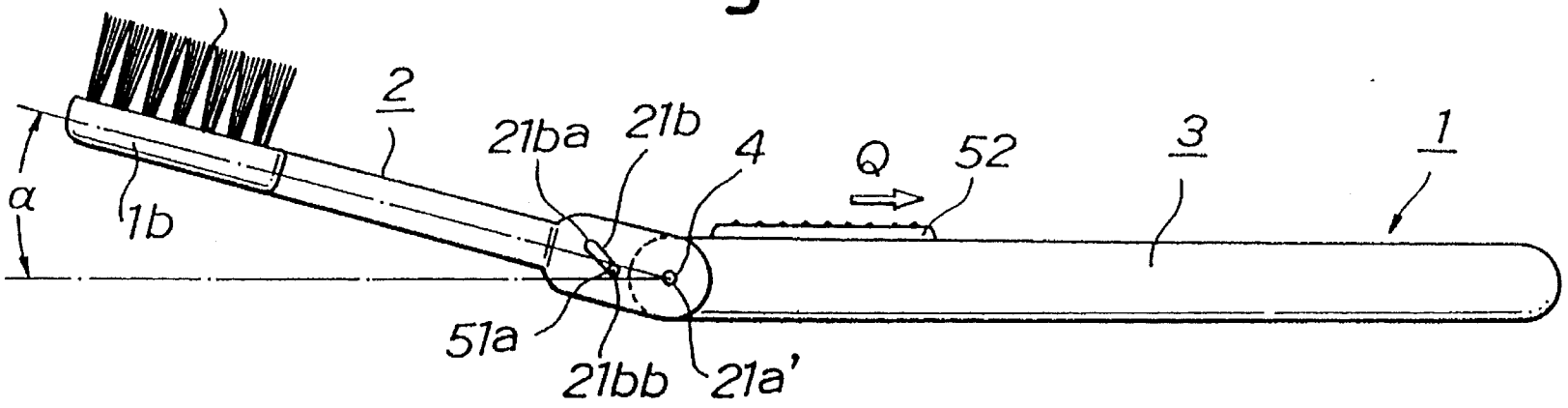

FIG. 1 is a perspective view showing an outer appearance of a toothbrush according to one embodiment of the present invention, FIG. 2 is an exploded perspective view showing the toothbrush of FIG. 1, FIG. 3 is an enlarged plan view of a slant elongated-slit of a neck portion of the toothbrush of FIG. 1, FIG. 4 is an enlarged sectional view taken on line 4—4 of FIG. 1 but in which a slide member is removed therefrom, FIG. 5 is an enlarged sectional view taken on line 5—5 of FIG. 1, and FIG. 6*a* is a side view showing a state in which the bending angle of a neck portion relative to a handle portion is 0 in the toothbrush of FIG. 1, and FIG. 6*b* is a side view showing a state in which the bending angle of the neck portion relative to the handle portion is maximum in the toothbrush of FIG. 6*a*.

As shown in FIG. 1, in a toothbrush 1 of this embodiment, a basal end portion 21 of a neck portion 2 which neck portion having a bristle portion 1*b* at a distal end thereof is pivotally connected to a distal end portion 31 of a handle portion 3 through a pivotal pin 4, and a slide member 5 for fixedly maintaining the connected state between the basal end portion 21 and the distal end portion 31 is slidably arranged relative to the distal end portion 31 through the pivotal pin 4, so that by sliding the slide member 5 forwardly and backwardly relative to the handle portion 3, a bending angle of the neck portion 2 relative to the handle portion 3 can be adjusted.

As shown in FIG. 1, the basal end portion 21 of the neck portion 2 includes a pair of linkage portions 21*a* and 21*a* which are brought to opposite outer sides of the distal end portion 31 of the handle portion 3 and connected to the distal end portion 31 through the pivotal pin 4, and the pair of linkage portions 21*a* and 21*a* are each provided with a slant elongated-slit 21*b* positionally offset toward the bristle portion 1*b* from the linkage portions 21*a* and 21*a* with respect to the pivotal pin 4.

The handle portion 3 is provided with a slide guide groove 32 for guiding the slide member 5.

The slide member 5 includes a slide basic body 51 having an elongated-slit 51*b* and slidably fitted in the slide guide groove 32, and a slide control plate 52 integrally mounted on the slide basic body 51. The slide basic body 51 is provided with a pair of fit-in projections 6 and 6 respectively on opposite sides of a distal end portion 53 which is positionally offset toward the neck portion 2. The pivotal pin 4 is allowed to pierce through the elongated-slit 51*b*, and the fit-in projections 6 and 6 are slidably fitted in the slant elongated-slits 21*b* and 21*b*, respectively.

The toothbrush of this embodiment will be described in more detail. As shown in FIGS. 1 and 2, the linkage portions 21*a* and 21*a* have holes 21*a*' and 21*a*', respectively. The distal end portion 31 has a pair of holes 31*a* on opposite sides thereof. The single pivotal pin 4 is allowed to pierce through the holes 21*a*' and 31*a*, the elongated-slit 51*b*, and the holes 31*a* and 21*a*' in this order, whereby the neck portion 2 and the handle portion 3 are pivotally connected to each other.

As shown in FIGS. 1 and 2, the slant slit 21*b* is inclined such that one end portion 21*ba*, which is positionally offset toward the bristle portion 1*b*, is in a location positionally offset toward the bristle 1*a*. Owing to this arrangement, the neck portion 2 can be bent relative to the handle portion 3 in accordance with the angle of inclination of the slant slit 21*b*. It is preferable that this bending angle α is about 0 to 30 degrees. It is particularly preferable that the angle α is about 0 to 15 degrees.

As shown in FIG. 3, a diameter L' of each end portion 21*ba* (21*bb*) of the slant elongated-slit 21*b* is smaller than a diameter L of a central portion thereof. Owing to this arrangement, when the bending angle of the neck portion 2 relative to the handle portion 3 is adjusted, the fit-in projection (pin) 6 is positively secured to the end portion 21*ba* (21*bb*) as later described.

With respect to the neck portion 2, when the slider control plate 52 is slid in a direction of the neck portion 2 to the utmost extent as shown in FIG. 6*a*, the fit-in projection 6 is brought to the end portion 21*ba*, which is positionally offset toward the bristle portion 1*b*, of the slant elongated-slit 21*b*, so that the bending angle α of the neck portion 2 relative to the handle portion 3 becomes 0, and when the slider control plate 52 is slid in a direction of a rear end portion of the handle portion 3 to the utmost extent as shown in FIG. 6*b*, the fit-in projection 6 is brought to the end portion 21*bb*, which is positionally offset toward the handle portion 3, so that the bending angle α of the neck portion 2 relative to the handle portion 3 becomes maximum.

As shown in FIG. 1, the slide basic body 51 in the slide member 5 has a generally rectangular parallelepiped configuration, and the width of the slide control plate 52 is smaller than the width of the surface of the handle portion 3. As shown in FIGS. 1 and 5, the slide basic body 51 is integrally formed by the slide control plate 52 and a support member 54. Upon activation of the slide control plate 52, the slide basic body 51 is slid within the slide guide groove 32.

The slide groove 32 in the handle portion 3 extends, as shown in FIG. 4, from the distal end portion 31 toward the rear end of the handle portion 3. The slide groove 32 renders, as shown in FIG. 4, a convex shape in cross-section in the lateral direction. The slide basic body 51 and the support member 54 are to be fitted in the slide guide groove 32.

Accordingly, the slide member 5 allows only the slide control plate 52 to be exposed outside substantially.

In this embodiment, a hole 51*a* is formed in the distal end portion of the slide basic body portion 51. The single pin 6 is pierced through the slant elongated-slit 21*b* formed in the linkage portion 21*a*, the hole 51*a*, and the slant elongated-slit 21*b* formed in the other linkage portion 21*a*. The neck portion 2 and the slide member 5 are connected to each other. The pin 6 forms the above-mentioned fit-in projection 6.

On an upper surface of the slide control plate 52, a slip-preventive portion 52*a* is formed, as shown in FIGS. 1 and 5, so that a finger tip will not slip on the surface of the slide control plate 52.

Since the toothbrush 1 of this embodiment is thus constructed, for adjusting, in use, the bending angle of the neck portion 2 relative to the handle portion 3 depending on which tooth or which part of a tooth is to be brushed, when the slide control plate 52 is, as shown in FIG. 6*b*, slid in a direction of the rear end of the handle portion 3 (i.e., in a direction as indicated by an arrow Q in FIG. 6*b*) to the utmost extent by a finger such as the thumb of a single hand holding the handle portion 3, the fit-in projection (pin) 6 is, as shown in FIG. 6*b*, guided by the slant elongated-slit 21*b* from the end portion 21*ba*, which is positionally offset toward the bristle 1*a*, to the end portion 21*bb*, which is positionally offset toward the handle portion 3. At the same time, the neck portion 2 is turned or pivoted about the pivotal pin 4, so that the bending angle of the neck portion 2 relative to the handle portion 3 will become maximum.

When the slide control plate 52 is slid in a direction of the neck portion 2 to the utmost extent, the fit-in projection (pin) 6 is, as shown in FIG. 6*a*, moved from the end portion 21*bb* to the end portion 21*ba*. At the same time, the neck portion 2 is turned or pivoted about the pivotal pin 4 but in the reverse direction to the above-mentioned pivoted direction, so that the bending angle of the neck portion 2 relative to the handle portion 3 will become 0.

By stopping the sliding operation of the slide control plate 52 during the course of its utmost sliding operation in the direction of the rear end of the handle portion 3 or in the direction of the neck portion 2, the bending angle of the neck portion 2 relative to the handle portion 3 can be adjusted as desired.

In this way, in the above-mentioned toothbrush, by sliding the slide control plate 52 of the slide member 5 with a finger such as the thumb of a single hand holding the handle portion 3, the bending angle of the neck portion 2 relative to the handle portion 3 can be easily adjusted by a single hand.

It should be appreciated that the present invention is not limited to the above embodiment, and the configurations of the various parts and the connecting forms of and between the various parts can be appropriately adjusted without departing from the spirit of the present invention.

INDUSTRIAL APPLICABILITY

With respect to the toothbrush of the present invention, the bending angle of the neck portion relative to the handle portion can be easily adjusted, in use, by a single hand, depending on which tooth or which part of a tooth is to be brushed.

What is claimed is:

1. A toothbrush in which a basal end portion of a neck portion having a bristle portion at a distal end of said neck portion is pivotally connected to a distal end portion of a handle portion through a pivotal pin, and a slide member for fixedly maintaining the connected state between said basal end portion and said distal end portion is slidably arranged relative to said distal end portion through said pivotal pin, so that by sliding said slide member forwardly and backwardly relative to said handle portion, a bending angle of said neck portion relative to said handle portion can be adjusted, said basal end portion of said neck portion including a pair of linkage portions which are brought to outer sides of said distal end portion of said handle portion and connected to said distal end portion through said pivotal pin, said pair of linkage portions being each provided with a slant elongated-slit positionally offset toward said bristle portion from said pivotal pin, said handle portion being provided with a slide guide groove for guiding said slide member, said slide member including a slide basic body having an elongated-slit and slidably fitted in said slide guide groove, and a slide control plate integrally mounted on said slide basic body, said slide basic body being provided with a pair of fit-in projections formed respectively on opposite sides of said slide basic body at areas positionally offset toward said neck portion, said pivotal pin being allowed to pierce through said elongated-slit, said fit-in projections being slidably fitted respectively in said slant elongated-slits.

2. A toothbrush according to claim 1, in which when said slider control plate is slid in a direction of said neck portion to the utmost extent, the bending angle of said neck portion relative to the handle portion becomes 0, and when said slider control plate is slid in a direction of a rear end portion of said handle portion to the utmost extent, the bending angle of said neck portion relative to said handle portion becomes maximum.

3. A toothbrush according to claim 1, in which said slant elongated-slit is reduced in diameter at opposite end portions thereof.

4. A toothbrush according to claim 1, in which said slide member allows only said slide control plate to be exposed outside substantially.

* * * * *